US007111837B2

(12) United States Patent
Itou et al.

(10) Patent No.: US 7,111,837 B2
(45) Date of Patent: Sep. 26, 2006

(54) IMAGE FORMING APPARATUS INTEGRATING SHEET POSTPROCESSING APPARATUS

(75) Inventors: Hiroto Itou, Hachioji (JP); Kohji Yoshie, Hachioji (JP); Hitoshi Tamura, Hachioji (JP); Hisao Hosoya, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/651,450

(22) Filed: Aug. 29, 2003

(65) Prior Publication Data

US 2004/0046304 A1 Mar. 11, 2004

(30) Foreign Application Priority Data

Sep. 5, 2002 (JP) ..... 2002-259810

(51) Int. Cl.
*B65H 37/06* (2006.01)

(52) U.S. Cl. ..... 270/45; 270/32; 270/37; 493/444; 493/445

(58) Field of Classification Search ..... 270/32, 270/37, 45; 493/444, 445
See application file for complete search history.

(56) References Cited

U.S. PATENT DOCUMENTS 240,390 A * 4/1881 Cross et al. ..... 493/444
5,769,404 A * 6/1998 Kanou et al. ..... 270/37
6,027,107 A * 2/2000 Natsume et al. ..... 270/37
6,241,232 B1 * 6/2001 Schmitt et al. ..... 270/30.01
6,746,390 B1 * 6/2004 Tamura et al. ..... 493/445

FOREIGN PATENT DOCUMENTS

JP 2002060127 A * 2/2002

* cited by examiner

*Primary Examiner*—Patrick Mackey
(74) *Attorney, Agent, or Firm*—Squire, Sanders & Dempsey, L.L.P.

(57) ABSTRACT

This invention relates to a sheet postprocessing apparatus which includes a first crease forming unit for forming a first crease on a sheet in its width direction, a second crease forming unit for forming a second crease parallel to the first crease, a first abutting member against which the leading end of a sheet introduced into the first crease forming unit abuts to position the sheet, a second abutting member against which the first crease abuts to position the sheet, a first driving mechanism for driving the first abutting member, a second driving mechanism for driving the second abutting member, and a control device for controlling the first crease forming unit, first driving mechanism, second crease forming unit, and second driving mechanism, and makes one folding process selected from a center folding process, inward three-fold process, and Z-fold process executable in the same sheet convey path.

11 Claims, 14 Drawing Sheets

IMAGE FORMING APPARATUS INTEGRATING SHEET POSTPROCESSING APPARATUS

BACKGROUND OF THE INVENTION

1. Field of the Invention

The present invention relates to a sheet post-processing apparatus which receives sheets discharged from an image forming apparatus such as an electrophotographic copying machine, printer, facsimile apparatus, or a composite machine having these functions, and executes postprocessing such as a folding process.

2. Description of the Prior Art

Recently, various kinds of sheet postprocessing apparatuses have been proposed, which bundle and align a plurality of sheets on which image are recorded by an image forming apparatus such as a copying machine, and perform postprocessing such as binding and folding with respect to the aligned sheet bundle.

For example, as a sheet postprocessing apparatus for manufacturing a booklet by saddle-stitching the middle portion of this sheet bundle and center-folding the sheet bundle at the saddle-stitched portion, the apparatuses disclosed in Japanese Unexamined Patent Publication Nos. 10-181990 and 2001-2317 are known.

These sheet postprocessing apparatuses have a folding unit constituted by a pair of center folding rollers which rotate in tight contact with each other to fold a sheet bundle and a center folding plate which pushes the saddle-stitched portion of the sheet bundle to the press portion between the center folding rollers.

A sheet postprocessing apparatus having a folding unit for folding a sheet into three is disclosed in Japanese Unexamined Patent Publication No. 2002-60127. This sheet postprocessing apparatus forms a sealed document such as postal matter or direct mail by sealing or inserting one or a small number of three-folded sheets into an envelope.

A Z-fold apparatus is known, which forms the first crease on a sheet along a direction (width direction) perpendicular to its longitudinal direction, center-folds the sheet, and forms the second crease which is formed parallel to the first crease on the center-folded sheet and is used to fold back the sheet to the opposite side to the first folding side, thereby folding the sheet into three. A large-sized sheet is Z-folded and reduced in size to ½ or less by this Z-fold apparatus. The Z-folded sheet can therefore be stored in a small-sized file or the like. Unfolding this sheet allows an easy visual check.

When, however, the above Z-fold process is to be performed, a Z-fold apparatus must be connected to an image forming apparatus independently of a conventional sheet postprocessing apparatus designed to perform postprocessing such as a center folding process or three-fold process or must be singly installed in the image forming apparatus.

As described above, according to the prior art, an image forming system for separately performing postprocessing including a center folding process, three-fold process, and Z-fold process with respect to sheets discharged from an image forming apparatus is formed by connecting a Z-fold apparatus to the image forming apparatus in addition to the conventional sheet postprocessing apparatus for performing postprocessing including a center folding process and three-fold process.

In such an image forming system, the structure of the sheet postprocessing apparatus including the Z-fold apparatus becomes complicated, resulting in a high manufacturing cost.

SUMMARY OF THE INVENTION

The present invention has been made in consideration of the above situation in the prior art, and has as its object to provide a postprocessing apparatus which can realize various kinds of folding processes including a center folding process, three-fold process, and Z-fold process in the same sheet convey path.

In order to achieve the above object, according to the first aspect of the present invention, there is provided a sheet postprocessing apparatus for receiving a sheet discharged from an image forming apparatus and performing a folding process for the sheet, comprising a first crease forming unit which folds the sheet into two by forming a first crease on the sheet in a direction perpendicular to a longitudinal direction thereof, a second crease forming unit which folds the two-folded sheet into three by forming a second crease on the sheet so as to be parallel to the first crease, a first abutting member which is movable and against which a leading end of a sheet introduced into the first crease forming unit abuts to be positioned, a second abutting member which is movable and against which the first crease formed by the first crease forming unit abuts to be positioned, first driving means for driving the first abutting member, second driving means for driving the second abutting member, and control means for controlling the first crease forming unit, the first driving means, the second crease forming unit, and the driving means and selecting an inward three-fold process or a Z-fold process so as to make each selected process executable in the same sheet convey path.

According to the second aspect of the present invention, the control means described in the first aspect drives the first and second driving means in accordance with a paper size so as to move the first and second abutting members to predetermined positions.

According to the third aspect of the present invention, the first crease forming unit described in the first aspect is constituted by a pair of first folding rollers and a folding plate which pushes the sheet to a nip point of the first folding rollers, and the second crease forming unit is constituted by a pair of second folding rollers.

As is obvious from the respective aspects described above, the following effects are obtained by the sheet postprocessing apparatus of the present invention.

The folding unit of the postprocessing apparatus can realize various kinds of folding processes including a center folding process, three-fold process, and Z-fold process for sheets discharged from the image forming apparatus in the same sheet convey path. This eliminates the necessity to separately install various kinds of folding apparatuses. That is, the present invention is effective in, for example, simplifying the structure of the postprocessing apparatus, reducing the apparatus volume, and reducing the manufacturing cost. In addition, since the sheet convey path is also simplified, a sheet convey failure can be prevented.

The above and many other objects, features and advantages of the present invention will become manifest to those skilled in the art upon making reference to the following detailed description and accompanying drawings in which preferred embodiments incorporating the principle of the invention are shown by way of illustrative examples.

DETAILED DESCRIPTION OF THE PREFERRED EMBODIMENT

A preferred embodiment of the present invention will be described below with reference to the accompanying drawings.

Figure 1:
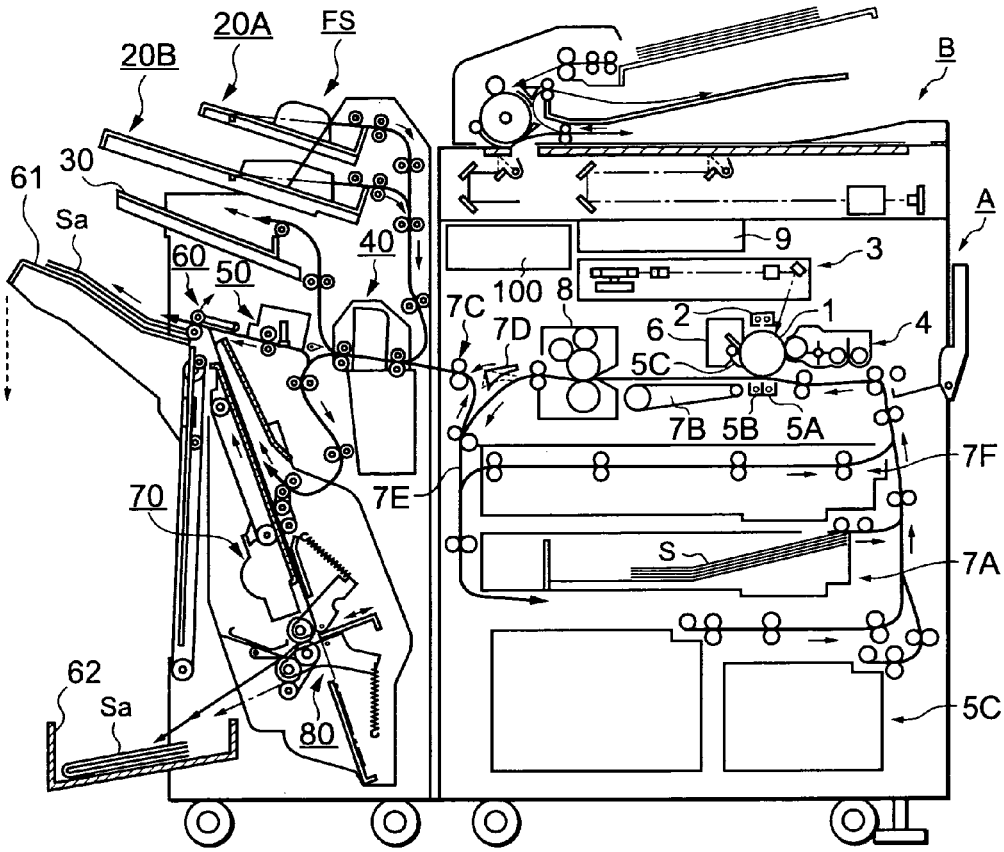
FIG. 1 is a schematic view showing the overall arrangement of an image forming system constituted by an image forming apparatus, image reading apparatus, and postprocessing apparatus.

FIG. 1 schematically shows the overall arrangement of an image forming system constituted by an image forming apparatus A, image reading apparatus B, and sheet postprocessing apparatus (to be referred to as a post-processing apparatus hereinafter) FS.

The image forming apparatus A has an image forming region in which a charging unit 2, image exposing unit (write unit) 3, developing unit 4, transfer unit 5A, discharging unit 5B, separating pawl 5C, and cleaning unit 6 are arranged around a rotating image carrier 1. The surface of the image carrier 1 is uniformly charged by the charging unit 2. After that, the surface of the image carrier 1 is exposed and scanned by a laser beam from the image exposing unit 3 on the basis of image data read from an original, thus forming a latent image. The latent image undergoes reversal development by the developing unit 4, thus forming a toner image on the surface of the image carrier 1.

A sheet S fed from a sheet storing unit 7A is sent to the transfer position. At the transfer position, the toner image is transferred onto the sheet S by the transfer unit 5A. Thereafter, charges on the lower surface of the sheet S are erased by the discharging unit 5B. The sheet S is separated from the image carrier 1 by the separating pawl 5C, conveyed by an intermediate convey unit 7B, and successively heated and fixed by a fixing unit 8. This sheet is temporarily conveyed to a lower reverse convey path 7E by a convey path switching plate 7D, and reversely conveyed to be discharged from a paper discharge unit 7C with the image-bearing surface facing down.

When images are to be formed on both surfaces of the sheet S, the sheet S heated/fixed by a fixing unit 8 is branched from the ordinary paper discharge path by the convey path switching plate 7D, and switched back to be reversed upside down on the reverse convey path 7E. The sheet S is then introduced to a paper feed path through a double-sided copy convey path 7F. After an image is transferred onto the sheet S in the image forming unit, the image is fixed by the fixing unit 8. The resultant sheet is discharged outside the apparatus. The sheet S discharged from the paper discharge unit 7C is fed into a receiving unit 10 of the postprocessing apparatus FS.

A developing agent remaining on the surface of the image carrier 1 after image formation is removed by the cleaning unit 6 downstream of the separating pawl 5C.

An operation unit 9 for selecting and setting an image formation mode and sheet postprocessing mode is placed on the front surface of the upper portion of the image forming apparatus A. The image reading apparatus B having an automatic document feeder designed to read an original while moving it is set on the upper portion of the image forming apparatus A.

Figure 2:
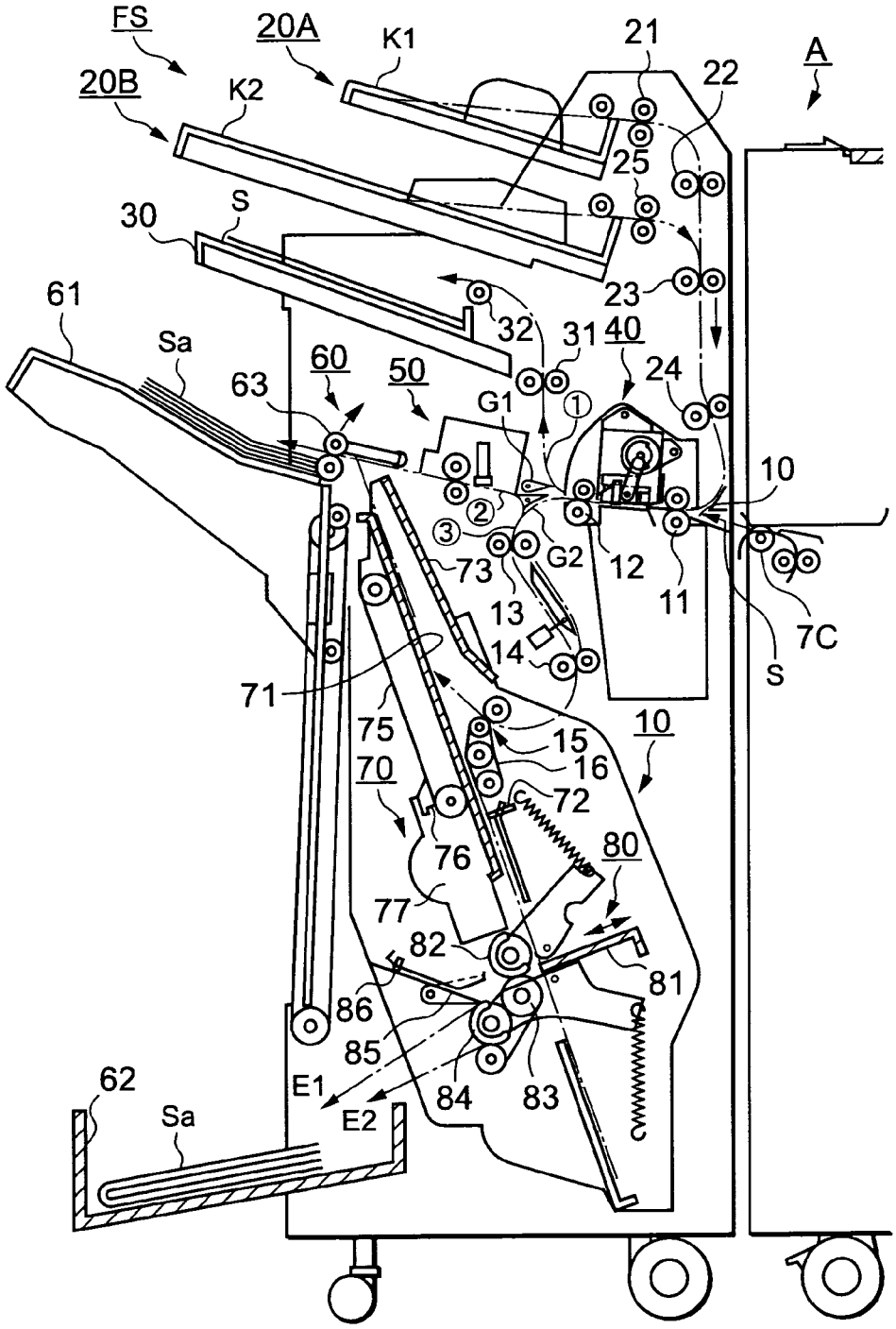
FIG. 2 is a view showing a sheet convey path in the postprocessing apparatus.

FIG. 2 shows the sheet convey paths for the sheets S in the postprocessing apparatus FS according to the present invention.

In the postprocessing apparatus FS, a first paper feeding unit 20A, second paper feeding unit 20B, and stationary paper discharge table 30 are arranged at the upper stage. A punching device 40, shift unit 50, and paper discharge unit 60 are arranged in series at the intermediate stage to form one substantially horizontal plane. A binding unit 70 and folding unit 80 are arranged in tandem at the lower stage to form one inclined plane.

A vertically movable paper discharge table 61 for stacking shifted sheets S and a bundle of end-bound sheets Sa thereon, and a stationary paper discharge table 62 for stacking a bundle of sheets Sa folded in three or two are arranged on the left side surface, in FIG. 2, of the postprocessing apparatus FS.

The position and height of the postprocessing apparatus FS are adjusted such that the receiving unit 10 for the sheet S delivered from the image forming apparatus body A coincides with the paper discharge unit 7C of the image forming apparatus A.

The receiving unit 10 of the postprocessing apparatus FS receives the sheet S having undergone image formation processing which is supplied from the image forming apparatus A, a slip sheet K1 that separates sheet bundles from each other and is fed from the first paper feeding unit 20A, and cover paper K2 fed from the second paper feeding unit 20B.

The slip sheet K1 stored in the paper feed tray of the first paper feeding unit 20A is separated and fed by a paper feeding unit 21 and then clamped by convey rollers 22, 23, and 24 so it is introduced to the receiving unit 10. The cover paper K2 stored in the paper feed tray of the second paper feeding unit 20B is separated and fed by a paper feeding unit 25 and then clamped by the convey rollers 23 and 24 so it is introduced to the receiving unit 10.

Note that sheets other than the slip sheet K1 and cover paper K2 may be loaded in the first paper feeding unit 20A and second paper feeding unit 20B. Sheets including the slip sheet K1 and cover paper K2 will be referred to sheets S hereinafter.

The punching device 40 is placed downstream of the receiving unit 10 in the paper sheet convey direction. The punching device 40 is comprised of a driving mechanism for detecting the width of the paper sheet and moving the punching device 40 in the width direction of the paper sheet, a punch edge vertically driving mechanism, a sheet width detecting device, and the like.

Registration rollers 11 are arranged upstream of the punching position of the punching device 40 in the sheet convey direction, and convey rollers 12 are arranged downstream of the punching position in the sheet convey direction.

As shown in FIG. 2, a sheet branching means comprised of switching units G1 and G2 is placed downstream of the punching unit 40 in the sheet convey direction. The switching units G1 and G2 select, as a sheet convey path, one of sheet convey paths in three directions by the driving operation of a solenoid or motor (not shown), that is, to either one of a first convey path ① serving as an upper paper discharge path, a second convey path ② serving as an intermediate paper discharge path, and a third convey path ③ serving as a lower paper discharge path.

When sheet conveyance for simple paper discharge operation is set, the switching unit G1 closes the second convey path ② and third convey path ③ and opens only the first convey path ①.

The sheets S passing through the first convey path ① move upward as they are clamped by convey rollers 31, are discharged by a paper discharge roller 32, and are placed on the stationary paper discharge table 30, so they are sequentially stacked on it.

When a convey mode for shift processing is set, the switching unit G1 retreats upward, and the switching unit G2 closes the third convey path ③ and opens the second convey path ② to allow the sheet S to pass through the second convey path ②. The sheet S passes through the sheet path formed between the switching unit G1 and G2.

The image-bearing sheet S discharged from the image forming apparatus A, the slip sheet K1 fed from the first paper feeding unit 20A, or the cover paper K2 fed from the second paper feeding unit 20B passes through the intermediate sheet path between the switching unit G1 and G2, is shifted by the shift unit 50 by a predetermined amount in a direction perpendicular to the sheet convey direction, and is discharged by the paper discharge unit 60.

When the mode of discharging sheets onto the vertically movable paper discharge table 61 is set, sheets S having undergone shift processing or not having undergone shift processing are discharged by the paper discharge unit 60 to the vertically movable paper discharge table 61 outside the apparatus and are sequentially stacked on it. When a large number of sheets S are to be discharged, the vertically movable paper discharge table 61 gradually moves down. The vertically movable paper discharge table 61 can store about 3,000 (A4 or B5) sheets S at maximum.

A side stitching process or saddle stitching process performed by the postprocessing apparatus according to the present invention will be described next.

Figure 3:
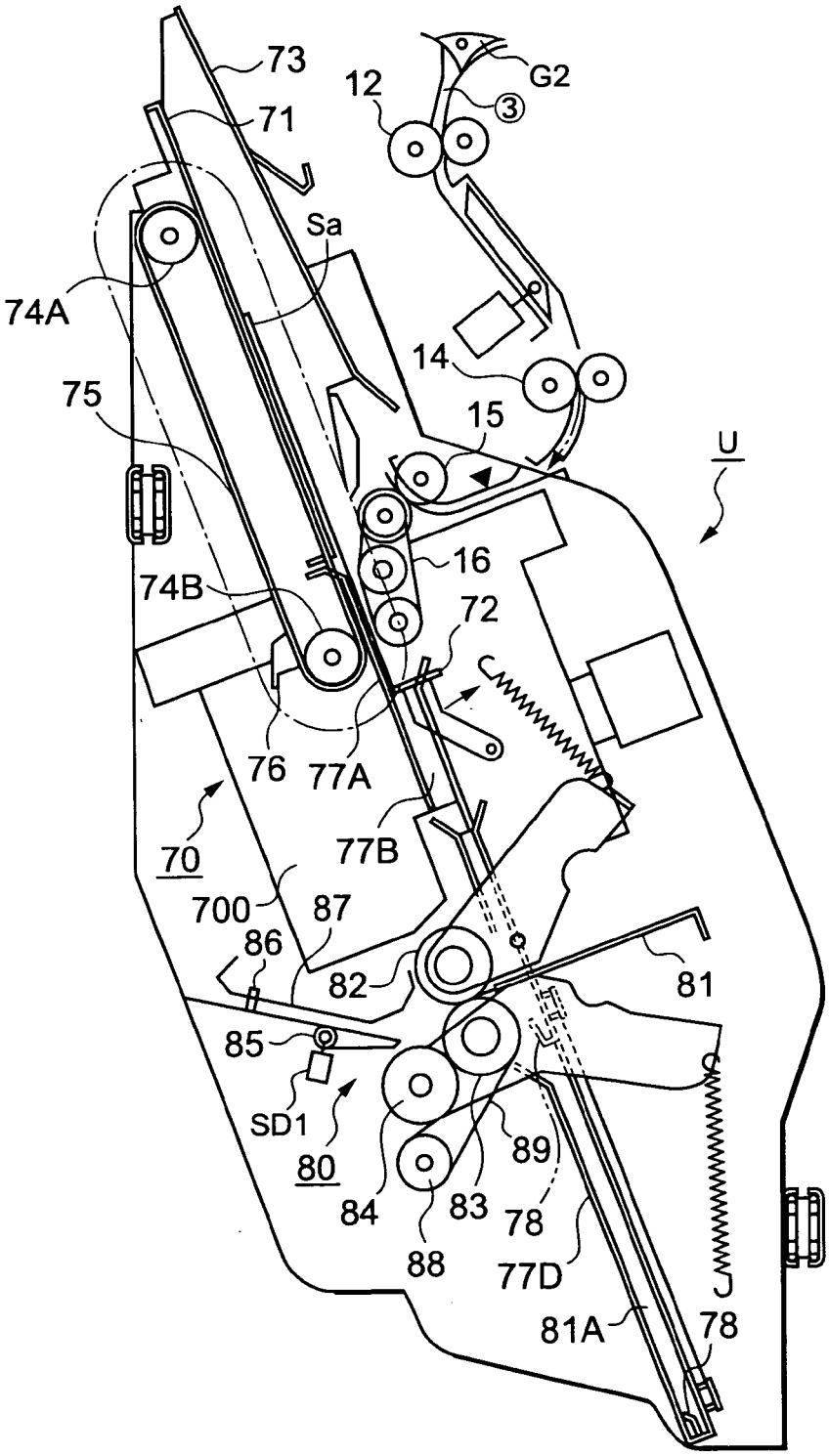
FIG. 3 is a longitudinal sectional view of a postprocessing unit constituted by a binding unit and folding unit.

(A) Side Stitching Process:

FIG. 3 is a longitudinal sectional view of a postprocessing unit U constituted by the binding unit 70 and folding unit 80.

When a side stitching process is set through the operation unit 9, the image-bearing sheet S which has undergone image formation processing in the image forming apparatus A and has been fed into the receiving unit 10 of the postprocessing apparatus FS passes though the punching device 40, and is fed to the third convey path ③ below the switching unit G2. This sheet is then clamped between convey rollers 13 and conveyed downward.

On the third convey path ③, the sheet S is conveyed by convey rollers 14 and its leading end in the convey direction abuts against the outer surfaces of an inlet convey roller pair 15. The sheet S then stops and is set in a standby state. At a predetermined timing, the inlet convey roller pair 15 rotates to convey the sheet S while clamping it and discharge it onto a stacker 71.

After the trailing end of the sheet S in the convey direction is discharged from the nip point of the inlet convey roller pair 15, the sheet S descends along the inclined surface of the stacker 71 by its own weight. When the trailing end of the sheet S in the convey direction abuts against a side-stitching abutting member 72 placed near a binding apparatus 700, the sheet S stops. A winding belt 16 in the form of an endless belt, which is placed downstream of the inlet convey roller pair 15 and pivots, comes into slidable contact with the trailing end of the sheet S in the convey direction, and feeds it to the side-stitching abutting member 72.

A pair of width aligning members 73 movably mounted on two side surface of the stacker 71 can move in a direction perpendicular to the sheet convey direction. When the sheet S is in a received state immediately before it is conveyed onto the stacker 71, the width aligning members 73 are opened wider than the sheet width. When the sheet S is conveyed onto the stacker 71 and abuts against the side-stitching abutting member 72 to stop, the width aligning members 73 lightly hit the side edges of the sheets S in the width direction to align (width-align) the sheet bundle Sa in the width direction. When a predetermined number of sheets S are stacked and aligned on the stacker 71 at this stop position, the binding apparatus 700 performs a side stitching process to bind the sheet bundle Sa.

Figure 7A:
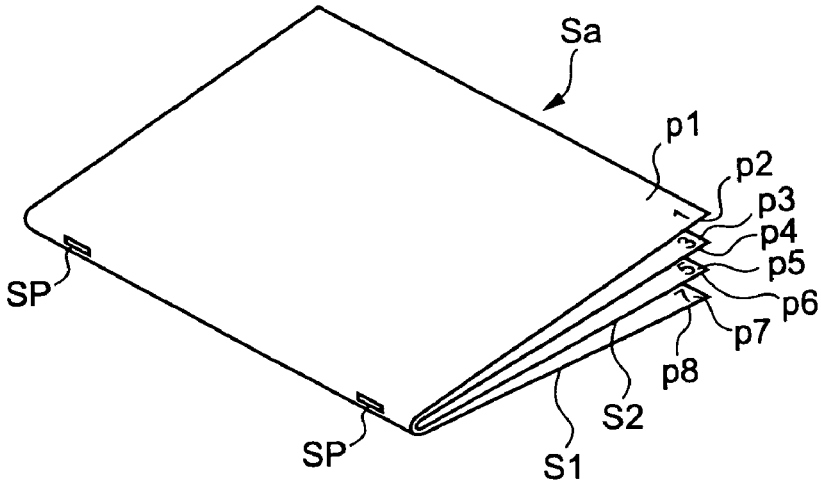
FIGS. 7A, 7B, and 7C are a perspective view of a sheet bundle having undergone a saddle stitching process and center folding process, a perspective view showing the postprocessed sheet bundle in an open condition, and a schematic sectional view of the sheet bundle, respectively.
Figure 7B:
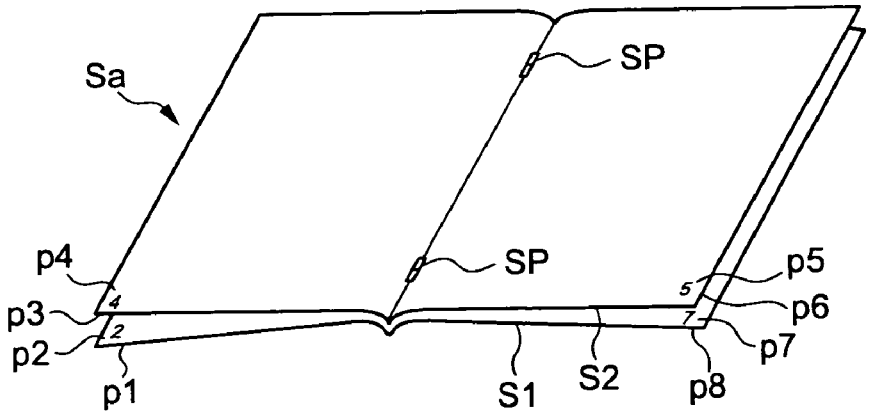
Figure 7C:
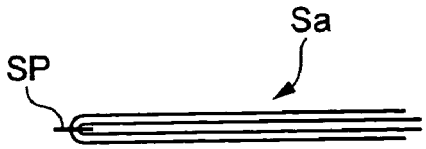

A notch is formed in part of the sheet stacking surface of the stacker 71, and a paper discharge belt 75 wound on a driving pulley and driven pulley is pivotally driven. A paper discharge pawl 76 is integrally formed on part of the paper discharge belt 75. The side-stitched sheet bundle Sa is placed on the paper discharge belt 75 as the trailing ends of the sheets S in the convey direction are pushed by the paper discharge pawl 76 of the paper discharge belt 75. The sheets S slide on the sheet stacking surface of the stacker 71 and are pushed obliquely upward to travel to the nip point of paper discharge rollers 63 of the paper discharge unit 60. The sheet bundle Sa clamped by the rotating paper discharge rollers 63 is discharged onto the vertically movable paper discharge table 61 and stacked there. (see FIG. 2). (B) Saddle Stitching Process:

When a saddle stitching process is set through the operation unit 9, the binding apparatus 700 of the binding unit 70 drives staples into the aligned sheet bundle Sa at two positions on the middle portion in the convey direction (see FIGS. 7A to 7C).

When a saddle stitching process is set, the side-stitching abutting member 72 near the binding positions (stapling positions of the staples) of the binding apparatus 700 retreats from the convey path. Almost simultaneously, a first abutting member 78 serving both as a saddle-stitching member and a center-folding member Located downstream of the side-stitching abutting member 72 moves toward the extension surface of a paper path 77A to close a paper path 77B.

When the size (length in the convey direction) of the sheets S are set or detected, a saddle-stitching stopper unit having the first abutting member 78 moves to a position where it abuts against the lower end of the sheet bundle Sa to be saddle-stitched, and stops. sheets S delivered from the image forming apparatus A pass through the receiving unit 10 of the postprocessing apparatus FS and the third convey path ③ and are sequentially stacked on the stacker 71. When the trailing ends of the sheets S in the convey direction abut against the first abutting member 78, the sheets S are positioned.

After the last sheet S is positioned and placed on the stacker 71, the sheet bundle Sa constituted by the cover paper K2 and all pages of the sheets S are saddle-stitched by the binding apparatus 700. By this saddle stitching process, staples SP are driven into the middle portions of the sheets S in the convey direction (see FIGS. 7A to 7C). The staples SP are driven from the staple driving mechanism on the stitcher side toward the stable receiving mechanism on the staple clincher side.

Figure 4:
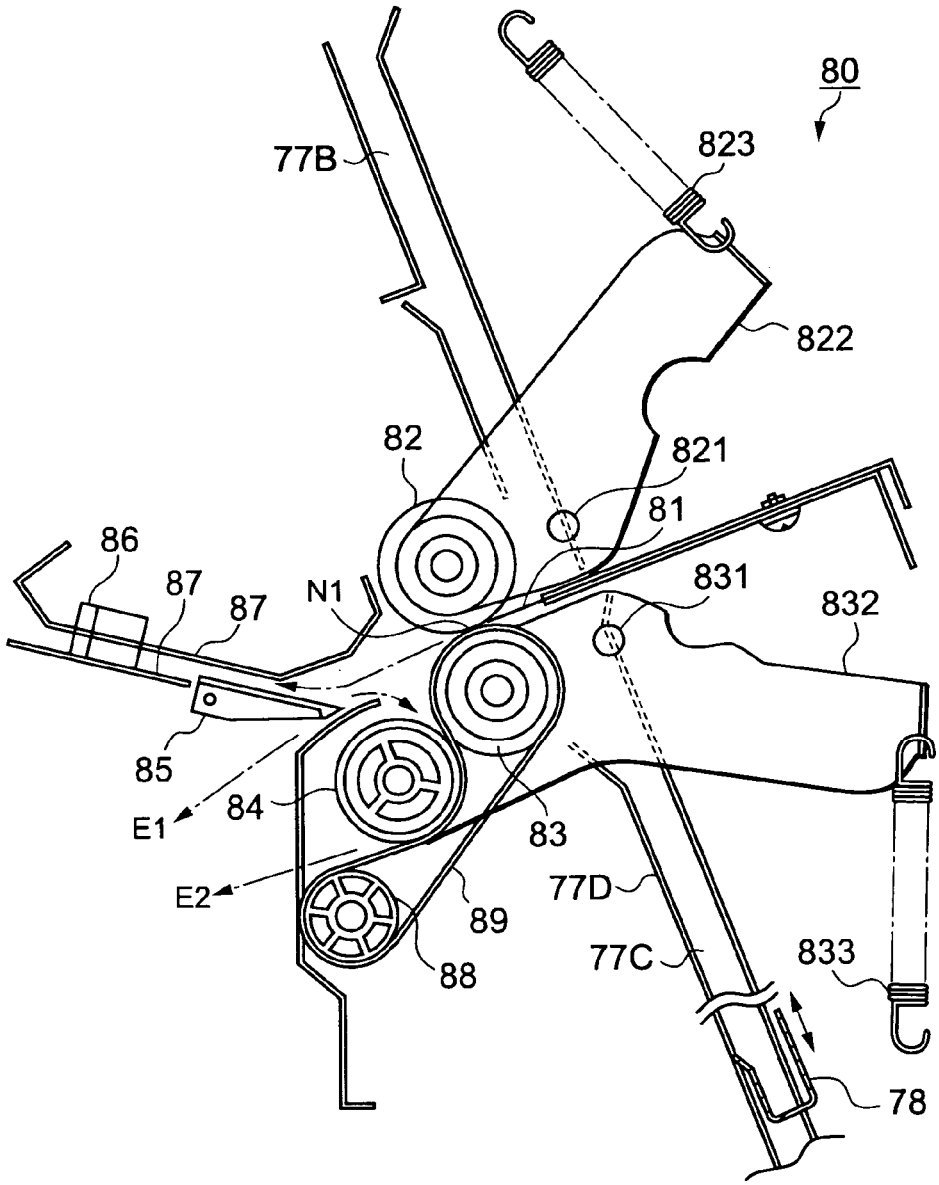
FIG. 4 is a longitudinal sectional view of the folding unit.

FIG. 4 is an enlarged sectional view of the folding unit 80.

Referring to FIG. 4, the folding unit 80 is placed on the lower right side of the binding unit 70. After a saddle stitching process, the first abutting member 78 linearly moves downstream of the sheet bundle Sa in the convey direction to open the lower path of the paper path 77A. The first movable abutting member 78 regulates, at an upper position, the stop position of the sheet bundle Sa in a saddle stitching process, and regulates, at a lower position, the stop position of the sheet bundle Sa in a center folding process.

The saddle-stitched sheet bundle Sa is conveyed to the lower right in FIG. 4 in a paper path 77C formed by a guide plate 77D. When the leading end of the sheet bundle Sa in the convey direction abuts against the first abutting member 78, the sheet bundle Sa is stopped at a predetermined position. Note that the first abutting member 78 can be moved to a predetermined position by a driving mechanism in accordance with a paper size setting or detection result.

The stacker 71 and paper paths 77A, 77B, and 77C are formed in almost the same plane and form a sharp inclination of about 70° with respect to the horizontal plane.

The folding unit 80 is comprised of a folding plate 81, folding rollers 82, 83, and 84, switching member 85, second abutting member 86, and the like. The folding unit 80 performs a center folding process or a three-fold process for the sheet bundle Sa.

The folding rollers 82 and 83 press against each other at a nip point N1 and are supported by a pair of left and right pressing mechanisms which are substantially symmetric.

One pressing mechanism is formed of the folding roller 82, a support plate 822 which rotatably supports the folding roller 82 and is swingable about a support shaft 821 as the center, and a spring 823 which is locked at one end of the support plate 822 and biases the folding roller 82 toward the nip point N1.

The other pressing mechanism is formed of the folding roller 83, a support plate 832 which rotatably supports the folding roller 83 and is swingable about a support shaft 831, and a spring 833 which is locked at one end of the support plate 832 and biases the folding roller 83 toward the nip point N1.

Figure 5:
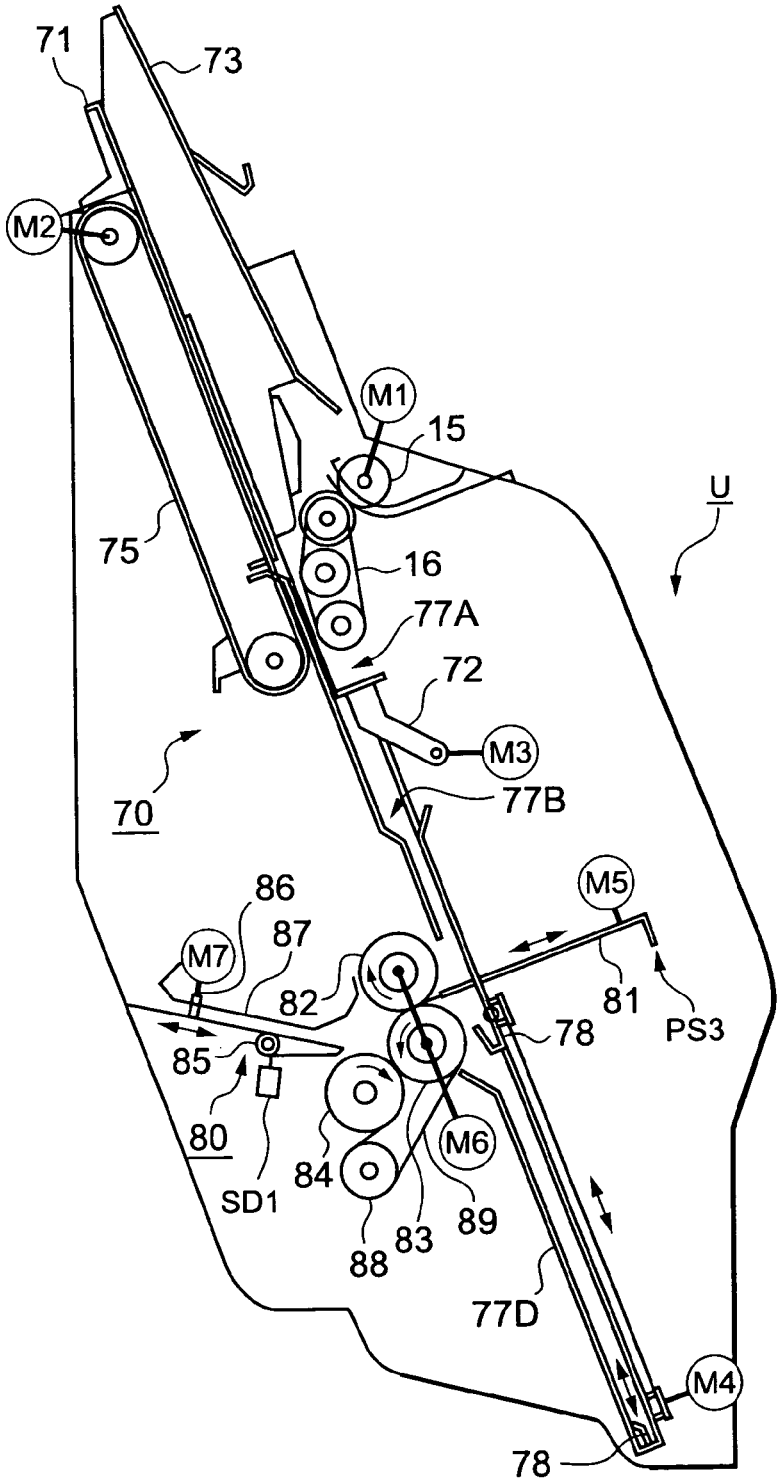
FIG. 5 is a view showing a driving system for the postprocessing unit constituted by a binding unit and folding unit.

The folding rollers 82 and 83 are driven/rotated by a folding roller driving mechanism (M6 in FIG. 5). Note that the outer surfaces of the folding rollers 82 and 83 are made of a material with a high frictional resistance.

The switching member 85 can be swung by a solenoid SD1 (see FIG. 3). In a center folding process, the switching member 85 guides the discharged sheet S to a center-folding outlet E1. In a three-fold process, the switching member 85 guides the sheet S to a guide plate 87.

A convey belt 89 is wound on the folding roller 83 and a tension roller 88. The convey belt 89 can pivot upon coming into tight contact with the folding roller 84. The sheet S folded into three by the folding rollers 83 and 84 is clamped and discharged by the convey belt 89.

FIG. 5 shows the driving system of the postprocessing unit U constituted by the binding unit 70 and folding unit 80.

In the binding unit 70, a motor M1 rotates the inlet convey roller pair 15 and winding belt 16. A motor M2 reciprocally moves the width aligning members 73. The paper discharge belt 75 is pivoted by a drive source (not shown) placed on the main body side of the postprocessing apparatus FS. A motor M3 swings the side-stitching abutting member 72 to open/close the paper paths 77A and 77B.

In the folding unit 80, a motor M4 moves the first abutting member 78 along the guide plate 77D in accordance with the paper size and folding mode. A motor M5 moves the folding plate 81 forward and backward with respect to the nip point between the folding rollers 82 and 83. A motor M6 rotates the folding rollers 82, 83, and 84 and convey belt 89. A motor M7 moves the second abutting member 86 along the guide plate 87.

The solenoid SD1 swings the switching member 85 to switch between the three folding convey path and the center folding path.

Various kinds of folding processes by the postprocessing apparatus of the present invention will be described next.

(1) Center Folding Process:

FIGS. 6A to 6D sequentially show the steps in a center folding process by the folding unit 80.

Figure 6A:
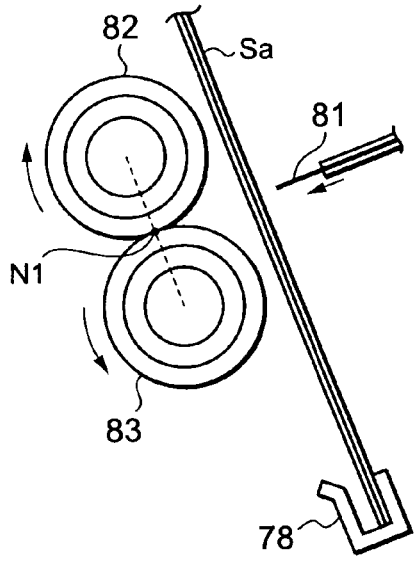
FIGS. 6A to 6D are sectional views of the main part of the folding unit, which show the steps in a center folding process.

FIG. 6A shows an initial state before a center folding process. The leading end of the sheet bundle Sa in the traveling direction, which has slid down the guide plate 77D (see FIG. 5), abuts against the first abutting member 78 set at a position corresponding to the paper size so as to be positioned. The folding plate 81 has been stood by at the initial position.

Figure 6B:
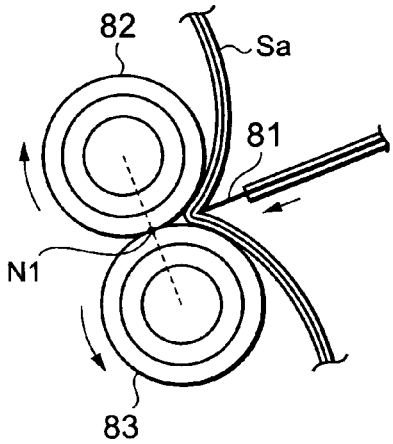

FIG. 6B shows a state wherein the folding plate 81 moves forward while pressing the sheet bundle Sa toward the nip point N1 between the pair of folding rollers 82 and 83 so as to press the middle portion of the sheet bundle Sa against the outer surfaces of the folding rollers 82 and 83.

Figure 6C:
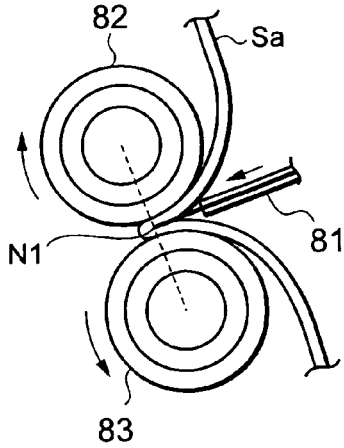

FIG. 6C shows a state wherein the folding plate 81 further moves forward to push apart the rotating folding rollers 82 and 83 at the nip point N1 so as to form a crease on the sheet bundle Sa, thereby performing a center folding process.

Figure 6D:
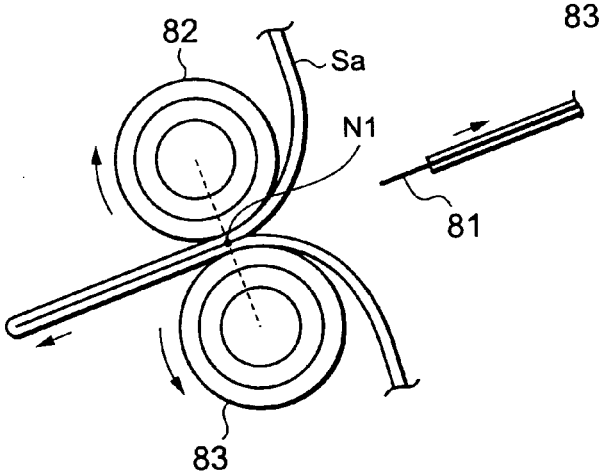

FIG. 6D shows a state wherein the folding plate 81 retreats from the nip point N1 between the folding rollers 82 and 83 and returns to the initial position, and the center-folded sheet bundle Sa is discharged by the rotating folding rollers 82 and 83.

As shown in FIGS. 7A to 7C, in the sheet bundle Sa formed by a saddle stitching process and center folding process, the first surface (p1 and p8) of a sheet S1 faces outward, the second surface (p2 and p7) of the sheet S1 is arranged on the lower side of the first page, the first surface (p3 and p6) of a sheet S2 is arranged inside the second page, and the second surface (p4 and p5) of the sheet Ss is arranged inside the first surface. Thus, the pages of the sheet bundle Sa formed of 8 pages (p1 to p8) can be aligned as shown in FIGS. 7A to 7C.

The folding unit 80 shown in FIG. 4 can execute three modes, i.e., a center folding process, inward three-fold process, and Z-fold process.

Figure 8A:
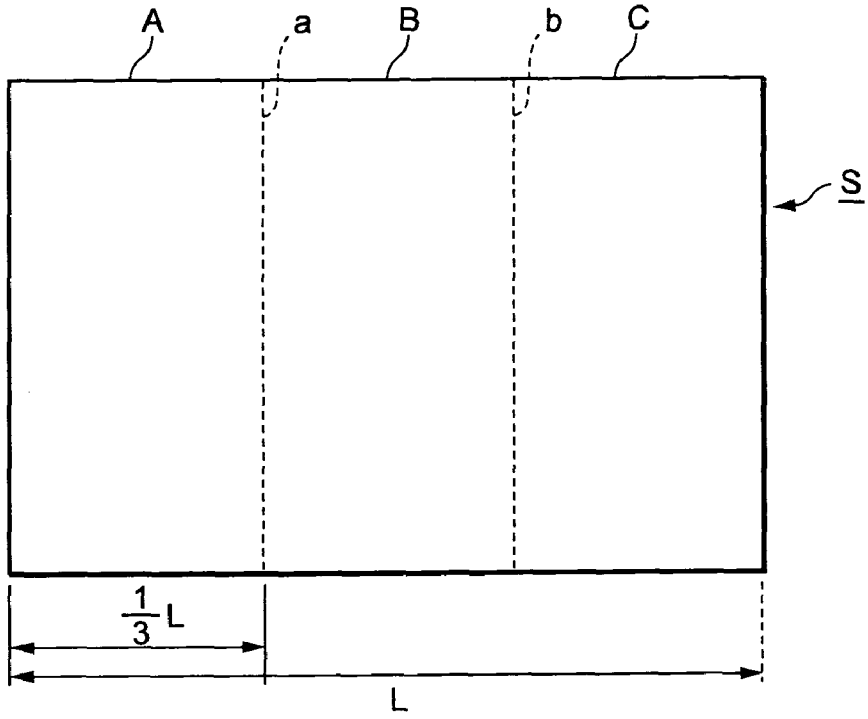
FIGS. 8A and 8B are a developed plan view of a sheet subjected to an inward three-fold process and a perspective view of the inwardly three-folded sheet, respectively.
Figure 8B:
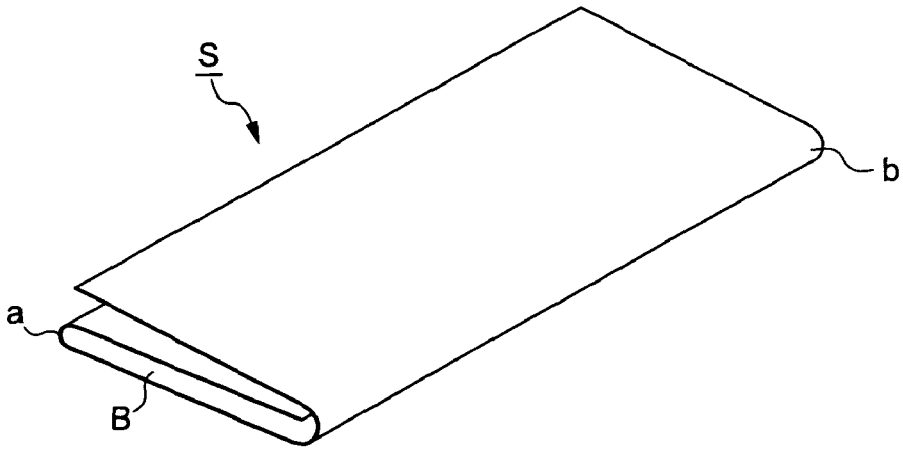

(2) Inward Three-Fold Process:

As shown in FIGS. 8A and 8B, in an inward three-fold process, the sheet S is folded on the same side into three surfaces A, B, and C along first and second creases a and b that divide a total length L of the sheet S in the longitudinal direction into three equal segments. That is, the sheet S is folded inward along the first crease a first, and then folded inward along the second crease b.

Note that in a three-fold process, a small number of sheets (e.g., three sheets) can be simultaneously folded. The three-folded sheet S can be folded into a small size so as to be put in an envelope as general mail.

FIGS. 9A to 9E sequentially show the steps in an inward three-fold process.

The folding unit 80 has the first crease forming unit for forming the first crease a on the sheet S and the second crease forming unit for forming the second crease b on the sheet S.

The first crease forming unit is constituted by the pair of folding rollers 82 and 83 and the folding plate 81. The second crease forming unit is constituted by the folding roller 84, switching member 85, guide plate 87, and second abutting member (also called a sheet leading end stopping member) 86.

Figure 9A:
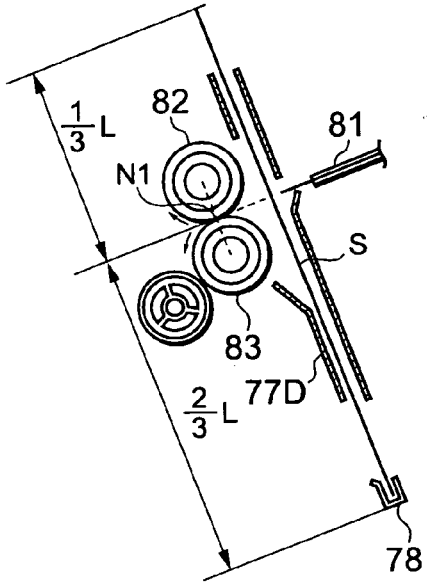
FIGS. 9A to 9E are sectional views showing the steps in an inward three-fold process.

(2-1) FIG. 9A shows the initial position in an inward three-fold process. The leading end of the sheet S has stopped upon abutting against the first abutting member 78. At the stop position of the sheet S, the first abutting member 78 is positioned such that the distance from the intersection of a broken line connecting the nip point N1 between the folding rollers 82 and 83 and the folding plate 81 to the sheet abutting surface of first abutting member 78 becomes ⅔ the total length L of the sheet S.

Figure 9B:
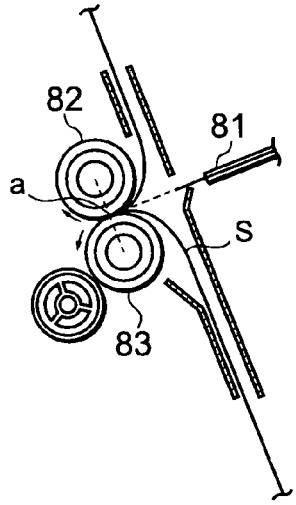

(2-2) Referring to FIG. 9B, the distal end portion of the folding plate 81 presses the sheet S at the position of the first crease a to be formed thereon so as to insert it between the folding rollers 82 and 83 at the nip point N1. The folding rollers 82 and 83 rotate in the directions indicated by the solid arrows to clamp the sheet S while forming the first crease a on the sheet S. After the first crease a is formed by the folding rollers 82 and 83, the folding plate 81 retreats from the nip point N1 and returns to the initial position.

Figure 9C:
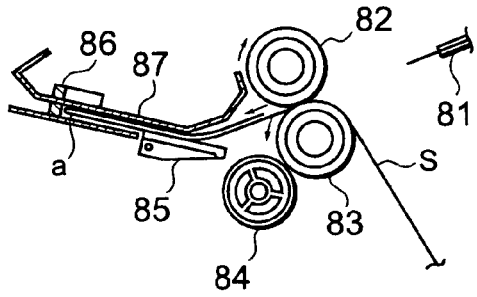

(2-3) As shown in FIG. 9C, the leading end of the sheet S on which the first crease a is formed between the folding rollers 82 and 83 is conveyed in the direction indicated by the solid arrow by the rotating folding rollers 82 and 83, travels along the upper surface of the switching member 85, and passes through the pair of opposing guide plates 87. The first crease a of the sheet S then abuts against the second abutting member 86.

Note that the second abutting member 86 is positioned in advance such that the sheet convey distance from the nip point N2 of the folding rollers 83 and 84 to the sheet abutting surface of the second abutting member 86 becomes ⅓ the total length L of the sheet S in the convey direction.

Figure 9D:
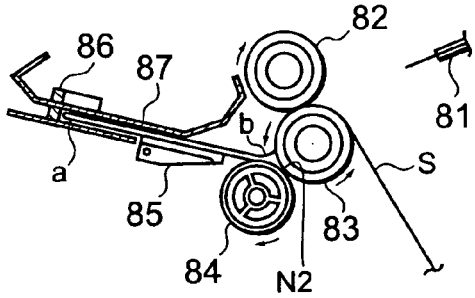

(2-4) As shown in FIG. 9D, as the folding rollers 82 and 83 continuously rotate, the first crease a of the sheet S abuts against the second abutting member 86 and so its onward movement is blocked. A trailing end portion of the sheet S which corresponds to ⅓ the length is wound around the outer surface of the folding roller 83 having a high frictional resistance and conveyed to the nip point N2 where the folding rollers 83 and 84 are pressed against each other, thereby forming the second crease b on the sheet S.

Figure 9E:
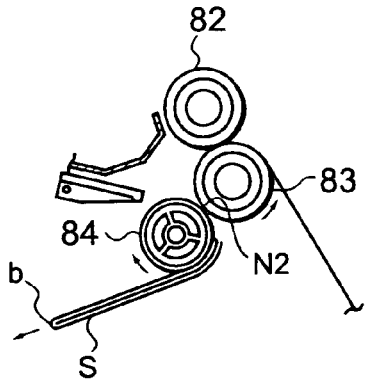

(2-5) As shown in FIG. 9E, after the sheet S is folded into three by forming the second crease b at the nip point N2 between the folding rollers 83 and 84 and folding back the leading and trailing ends, it is placed on the stationary paper discharge table 62 (see FIG. 2).

Figure 10:
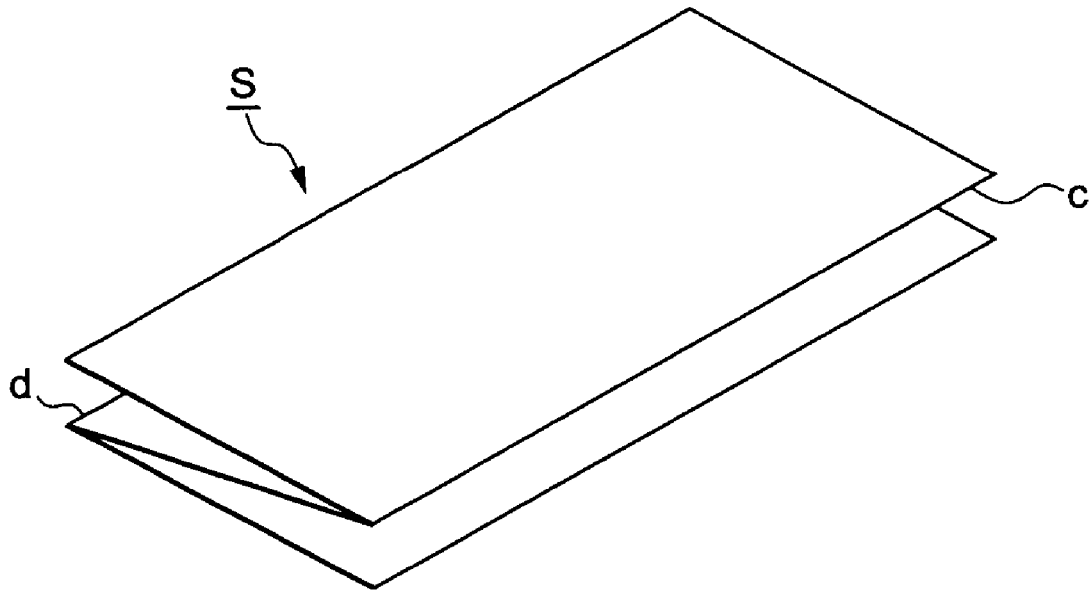
FIG. 10 is a perspective view of a sheet three-folded into a Z shape.

(3) Z-Fold Process of Reducing Paper Size to ⅓:

FIG. 10 is a perspective view of the sheet S folded into a Z shape.

The sheet S is folded into a Z shape by folding it along first and second creases c and d that almost equally divide in three the total length in its longitudinal direction. In this case, if the portion folded along the first crease c is located inside the sheet S, the portion folded along the second crease d is located outside the sheet S.

FIGS. 11A to 11E sequentially show the steps in a Z-fold process.

Figure 11A:
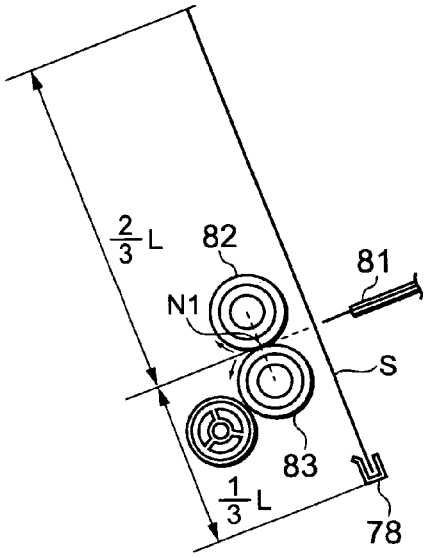
FIGS. 11A to 11E are sectional views showing the steps in a Z-fold process.

(3-1) FIG. 11A shows the initial position in a Z-fold process. The leading end of the sheet S has stopped upon abutting against the first abutting member 78. At this stop position of the sheet S, the first abutting member 78 is positioned such that the distance from the intersection (the position where the first crease c is to be formed) of a broken line connecting the nip point N1 between the folding rollers 82 and 83 of the first crease forming unit and the folding plate 81 to the sheet abutting surface of the first abutting member 78 becomes ⅓ the total length L of the sheet S.

Figure 11B:
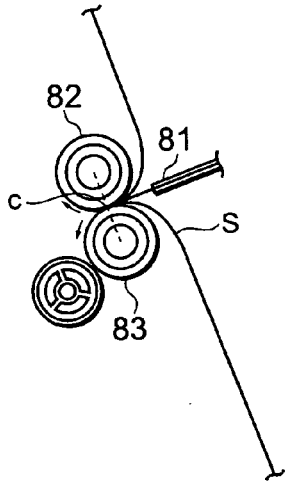

(3-2) Referring to FIG. 11B, the distal end portion of the folding plate 81 presses the sheet S at the position of the first crease c to be formed thereon so as to insert the sheet S between the folding rollers 82 and 83 at the nip point N1. The folding rollers 82 and 83 rotate in the direction indicated by the solid arrows to clamp the sheet S while forming the first crease c on the sheet S. After the first crease c is formed by the folding rollers 82 and 83, the folding plate 81 retreats from the nip point N1 and returns to the initial position.

Figure 11C:
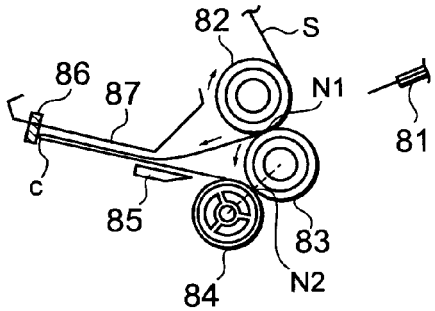

(3-3) As shown in FIG. 11C, the leading end of the sheet S on which the first crease c is formed between the folding rollers 82 and 83 is conveyed in the direction indicated by the sold arrow by the rotating folding rollers 82 and 83. The sheet S then travels along the upper surface of the switching member 85 and passes between the pair of opposing guide plates 87. As a consequence, the first crease c of the sheet S abuts against the second abutting member 86. At this time, the leading end of the sheet S has reached near the nip point N2 between the folding rollers 83 and 84.

The second abutting member 86 is positioned in advance such that the sheet convey distance from the nip point N2 between the folding rollers 83 and 84 to the sheet abutting surface of the second abutting member 86 becomes ⅓ the total length L of the sheet S in the convey direction.

Figure 11D:
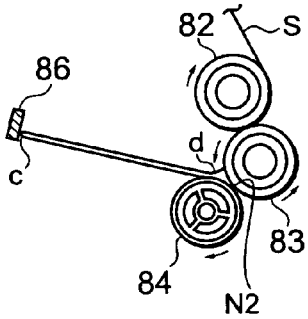

(3-4) As shown in FIG. 11D, as the folding rollers 82 and 83 continuously rotate, the first crease c of the sheet S abuts against the second abutting member 86 and so its onward movement is blocked. A trailing end portion of the sheet S which corresponds to ⅔ the length is wound around the outer surface of the folding roller 83 having a high frictional resistance and conveyed to the nip point N2 where the folding rollers 83 and 84 are pressed against each other, thereby forming the second crease d on the sheet S.

Figure 11E:
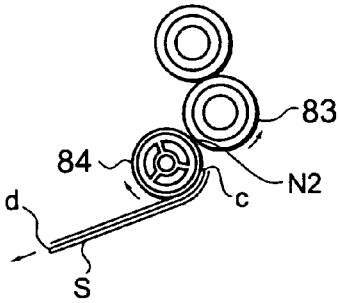

(3-5) As shown in FIG. 11E, after the sheet S is folded into a Z shape by forming the second crease d at the nip point N2 between the folding rollers 83 and 84 and folding back the ⅓ and ⅔ portions of the sheet S on the opposite sides, the sheet S is placed on the stationary paper discharge table 62 (see FIG. 2).

Figure 12A:
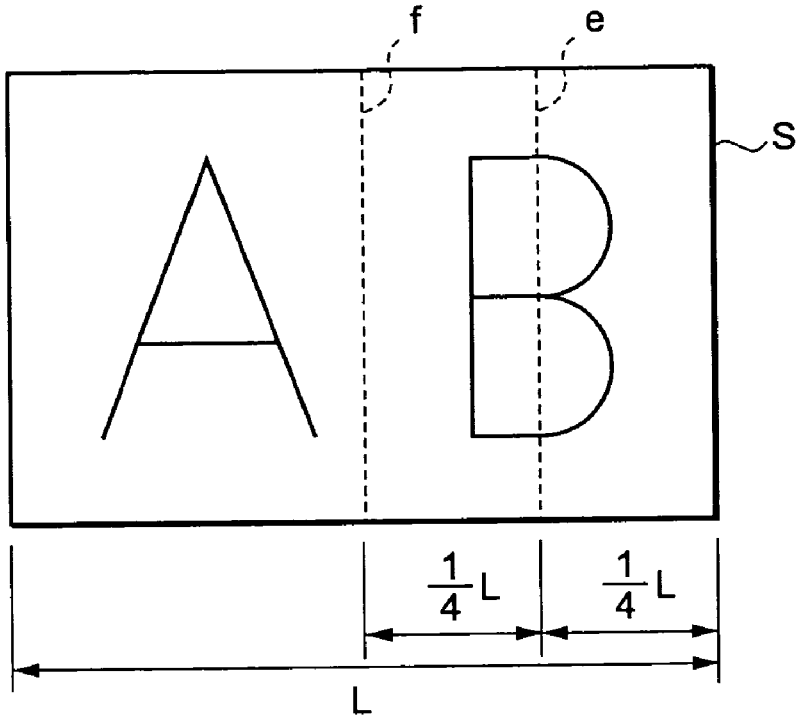
FIGS. 12A and 12B are a developed plan view of a sheet to be Z-folded and a perspective view of the Z-folded sheet, respectively.
Figure 12B:
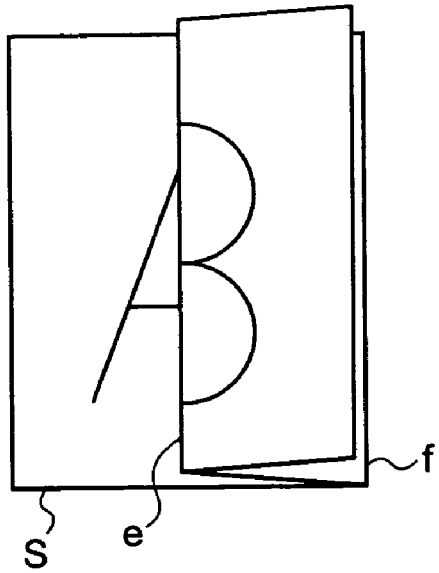

(4) Z-Fold Process of Reducing Paper Size to ½:

As shown in FIGS. 12A and 12B, the sheet S is folded into a Z shape by folding along first and second creases e and f that divide almost equally divide in four the total length L in the longitudinal direction of the sheet S. The sheet S to be folded into a Z shape is folded inward the shed along the first crease e, and is then folded outside the sheet along the second crease f.

Figure 13:
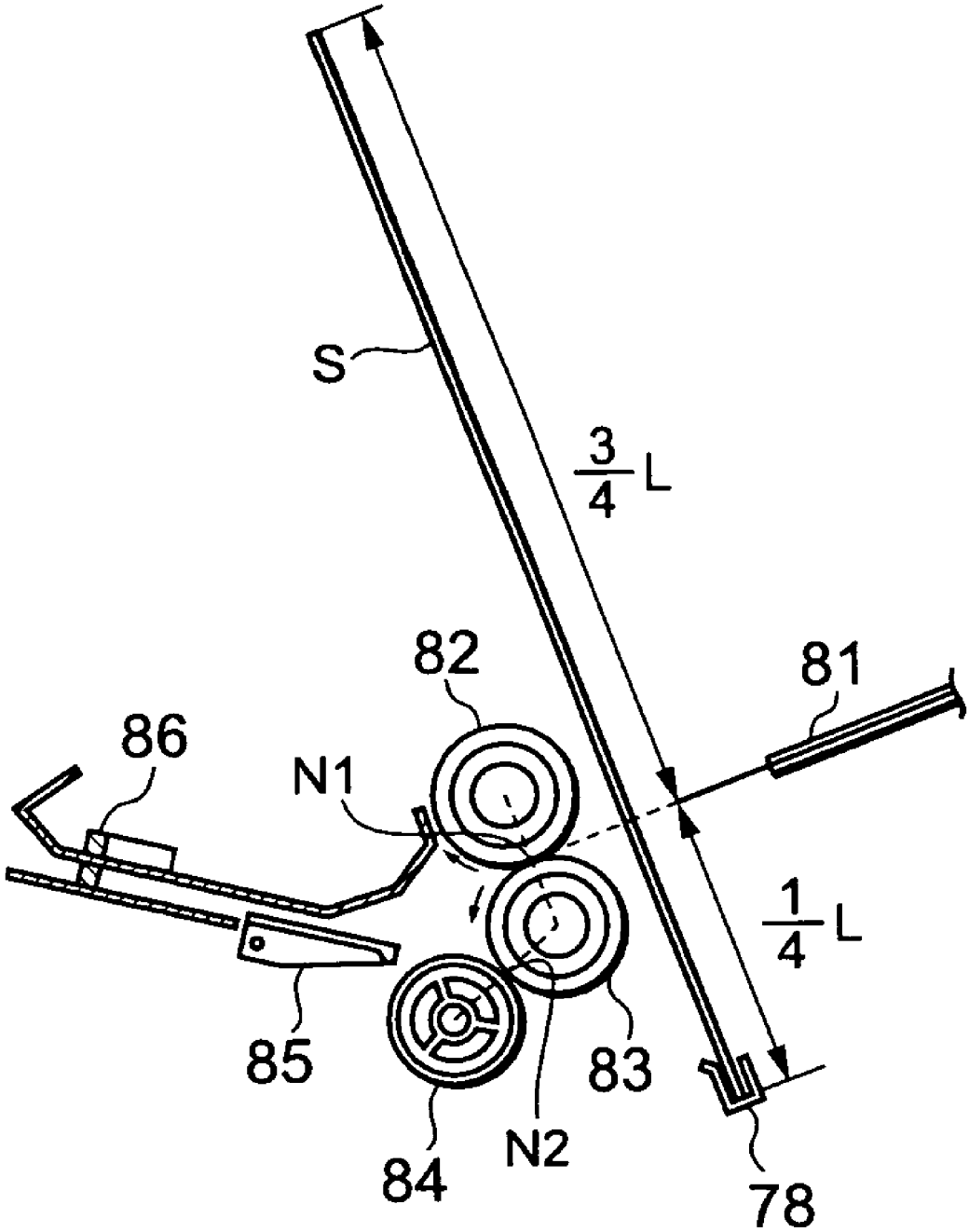
FIG. 13 is a sectional view showing an initial position in a Z-fold process.

FIG. 13 shows the initial position in a Z-fold process of reducing the paper sheet to ½. Referring to FIG. 13, the leading end of the sheet S in the traveling direction has stopped upon abutting against the first abutting member 78. At this stop position of the sheet S, the second abutting member 86 is positioned such that the distance from the intersection (the position of the first crease e) of a broken line connecting the nip point N1 between the folding rollers 82 and 83 and the sheet S to the sheet abutting surface of the first abutting member 78 becomes ¼ the total length L of the sheet S.

The second abutting member 86 is positioned in advance such that the sheet convey distance from the nip point N2 between the folding rollers 83 and 84 to the sheet abutting surface of the second abutting member 86 becomes ¼ the total length L of the sheet S in the convey direction.

The steps of folding the sheet S into a Z shape by forming the first and second creases e and f in the folding unit 80 in this manner are the same as those shown in FIGS. 11A to 11E, and hence a description thereof will be omitted.

The large-sized sheet S is folded into a Z shape and reduced in size to ½ or less. This folding process is effective for binding of a plurality of sheets and file binding.

One of various kinds of folding processes including a center folding process, inward three-fold process, ⅓-sized Z-fold process, and ½-sized Z-fold process is selected and set with the operation unit 9 of the image forming apparatus A.

Figure 14:
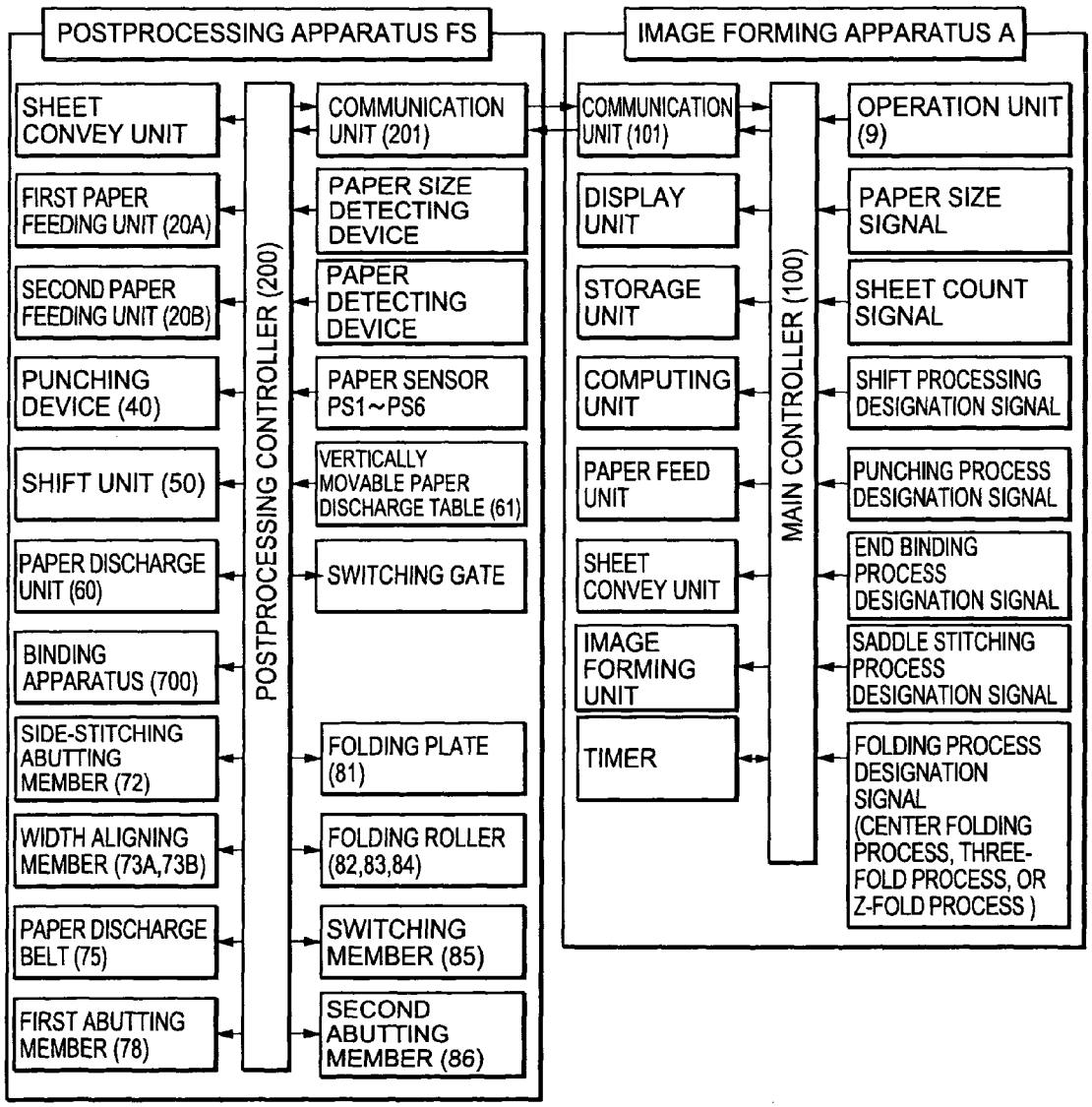
FIG. 14 is a block diagram showing control in the image forming apparatus body and postprocessing apparatus.

FIG. 14 is a block diagram showing various kinds of control in the image forming apparatus A and postprocessing apparatus FS.

A communication unit 101 of a main controller 100 of the image forming apparatus A is electrically connected to a communication unit 201 of a postprocessing controller 200 to exchange control signals with each other.

By processing operation selection with the operation unit 9, one of the following processes is set: a punching process by the punching device 40 of the postprocessing apparatus FS, a shift process by the shift unit 50, an end binding process and saddle stitching process by the binding unit 70, and center folding, three-fold, and Z-fold processes by the folding unit 80.

With this setting, the main controller 100 sends a control signal to the postprocessing apparatus FS through the communication unit 101. The control signal is transferred to the postprocessing controller 200 through the communication unit 201. The postprocessing controller 200 drives the set processing apparatus, processing unit, and driving mechanism.

If the size of the sheet S to be folded is set to be constant, the corresponding driving mechanism can be omitted by manually adjusting the first abutting member 78 and second abutting member 86 to predetermined positions.

The above embodiment of the present invention has exemplified the postprocessing apparatus connected to the copying machine body. However, the present invention can be applied to a postprocessing apparatus connected to an image forming apparatus such as a printer, facsimile apparatus, or composite apparatus.

What is claimed is:

1. A sheet postprocessing apparatus for receiving a sheet discharged from an image forming apparatus and performing a folding process for the sheet, comprising:

a first crease forming unit which folds the sheet into two by forming a first crease on the sheet in a direction perpendicular to a longitudinal direction thereof;

a second crease forming unit which folds the two-folded sheet into three by forming a second crease on the sheet so as to be parallel to the first crease;

a first abutting member which is movable and against which a leading end of a sheet introduced into said first crease forming unit abuts to be positioned;

a second abutting member which is movable and against which the first crease formed by said first crease forming unit abuts to be positioned;

a first driving device for driving said first abutting member;

a second driving device for driving said second abutting member;

a setting unit to selectively set an inward three-fold process and a Z-fold process; and a controller for controlling said first crease forming unit, said first driving device, said second crease forming unit, and said second driving device and selecting an inward three-fold process and a Z-fold process so as to make each selected process executable in the same sheet convey path, which guides the sheet to the first crease forming unit and guides the sheet on which a first crease is formed to the second crease forming unit, wherein the controller controls the first and second driving devices to move the first and second abutting members at a predetermined position in accordance with the inward three-fold process and the Z-fold process according to the setting operation at the setting unit.

2. An apparatus according to claim 1, wherein said controller drives said first and second driving devices in accordance with a paper size so as to move said first and second abutting members to predetermined positions.

3. An apparatus according to claim 1, wherein said first crease forming unit is constituted by a pair of first folding rollers and a folding plate which pushes the sheet to a nip point of the first folding rollers, and said second crease forming unit is constituted by a pair of second folding rollers.

4. An apparatus according to claim 3, wherein outer surfaces of the pair of first folding rollers constituting said first crease forming unit are made of a material with a high frictional resistance.

5. An apparatus according to claim 1, wherein said controller further selects a center folding process.

6. An apparatus according to claim 5, wherein said controller controls the first and second abutting members in accordance with the selected process out of the inward three-fold process, the Z-fold process, and the center folding process.

7. An apparatus according to claim 1, wherein the Z-fold process comprises a first Z-fold process by which a paper size is reduced to ⅓ and a second Z-fold process by which a paper size is reduced to ½.

8. A sheet postprocessing apparatus for receiving a sheet discharged from an image forming apparatus and performing a folding process for the sheet, comprising:

a first crease forming unit which folds the sheet into two by forming a first crease on the sheet in a direction perpendicular to a longitudinal direction thereof;

a first abutting member which is movable and against which a leading end of a sheet introduced into said first crease forming unit abuts to be positioned;

a second crease forming unit which folds the two-folded sheet into three by forming a second crease on the sheet so as to be parallel to the first crease;

a second abutting member which is movable and against which the first crease formed by said first crease forming unit abuts to be positioned;

a controller for controlling said first crease forming unit, said second crease forming unit, said first abutting member, and said second abutting member and selecting an inward three-fold process and a Z-fold process so as to make each selected process executable in a same sheet convey path, which guides the sheet to the first crease forming unit and guides the sheet, on which the first crease is formed, to the second crease forming unit, wherein the first and second abutting members are moved by the controller at a predetermined position in accordance with the inward three-fold process or the Z-fold process.

9. An apparatus according to claim 8, wherein said controller further selects a center folding process.

10. An apparatus according to claim 9, wherein said controller controls the first and second abutting members in accordance with the selected process out of the inward three-fold process, the Z-fold process, and the center folding process.

11. An apparatus according to claim 8, wherein the Z-fold process comprises a first Z-fold process by. which a paper size is reduced to ⅓ and a second Z-fold process by which a paper size is reduced to ½.

* * * * *